United States Patent [19]

Miyamoto

[11] 4,447,075

[45] May 8, 1984

[54] PRESSURE-SENSITIVE RECORDING MATERIAL

[75] Inventor: Akio Miyamoto, Shizuoka, Japan

[73] Assignee: Fuji Photo Film Co., Ltd., Kanagawa, Japan

[21] Appl. No.: 377,221

[22] Filed: May 11, 1982

[30] Foreign Application Priority Data

May 11, 1981 [JP] Japan ..... 56-70379

[51] Int. Cl.[3] ..... B41M 5/16; B41M 5/22

[52] U.S. Cl. ..... 346/213; 346/224

[58] Field of Search ..... 282/27.5; 427/150, 151; 428/320.6, 320.8, 537, 914, 341, 342, 402.2–402.22, 411

[56] References Cited

U.S. PATENT DOCUMENTS

| | | | |
|---|---|---|---|
| 3,193,404 | 7/1965 | Davis | 427/288 |
| 3,278,327 | 10/1966 | Davis | 282/27.5 |
| 3,793,075 | 2/1974 | Maalouf | 282/27.5 |

*Primary Examiner*—Bruce H. Hess

*Attorney, Agent, or Firm*—Sughrue, Mion, Zinn, Macpeak and Seas

[57] ABSTRACT

A pressure-sensitive recording material is described comprising a base having coated thereon microcapsules containing a solution including a benzhydrylsulfone type color former and an amine-hydrophobic alkylene oxide adduct.

14 Claims, No Drawings

PRESSURE-SENSITIVE RECORDING MATERIAL

FIELD OF THE INVENTION

This invention relates to a recording material and more particularly to a pressure-sensitive recording material which has improved resistance against staining of the coated surface thereof.

BACKGROUND OF THE INVENTION

It has long been known to obtain color images by contact reaction between an electron-donating or proton-accepting colorless organic compound (hereinafter referred to as a color former) and an electron-accepting or proton-donating solid acid (hereinafter referred to as a color developer). Examples of specifically utilizing this phenomenon are pressure-sensitive copying papers (for examples, U.S. Pat. Nos. 2,505,470, 2,505,489, 2,550,471, 2,548,366, 2,712,507, 2,730,456, 2,730,457, 3,418,250 and 3,672,935), heat-sensitive recording papers (for example, Japanese Patent Publication Nos. 4160/68, 7600/68, 14039/70, U.S. Pat. No. 2,939,009), and so forth.

Furthermore, a printing method is known which comprises supplying a color former-containing ink to a color developer-coated sheet to obtain colored images (German patent OLS No. 1,939,962).

The color developer has the above-described properties and examples thereof include acid clays, phenol resins, aromatic carboxylic acid metal salts, etc.

As the color former, there have been used compounds which are usually colorless, which possess a partial skeleton of lactone, lactam, sultone, spyropyran, ester, or amide, and which undergo ring cleavage or splitting of said partial skeleton when contacted with a color developer. Examples include triarylmethane compounds such as crystal violet lactone, xanthene compounds such as rhodamine B anilinolactam, spiro compounds such as 3-methyl-spiro-dinaphthopyran, thiazine compounds such as benzoyl leucomethylene blue, and leucoauramine compounds such as N-(o-chlorophenyl)leucoauramine.

However, colored products formed by the reaction between a color former of a triarylmethane compound, xanthene compound, spiro compound or the like and an acid clay have poor durability, and when contacted with water or an organic solvent undergo a reduction in density or the disappearance of color. Of organic solvents, polar solvents such as alcohols (e.g., ethanol, butanol, propylene glycol, glycerin, etc.), amines (e.g., monoethanolamine, triethanolamine, etc.), and esters and ethers (e.g., ethyl acetate, diethylene glycol, monomethyl ether, dioctyl phthalate, dibutyl phthalate, etc.) exert particularly strong influences on colored products when the organic solvents are contacted, directly or as a vapor, with the colored products, resulting in a reduction in color density or the total disappearance of color.

The inventors have formerly proposed to use benzhydrylsulfone type color formers so as to overcome the above-described defects as described in Japanese Patent Application No. 57593/81. However, when a benzhydrylsulfone type color former is encapsulated and coated on a base paper to prepare a coated paper, the resulting paper has the defect that the coated surface is stained bluish.

Known microencapsulating processes include a coacervation process, an interfacial polymerization process, an in situ polymerization process, etc.

In employing the coacervation process using gelatin, the above-described defect is not so serious. However, in the case of employing the interfacial polymerization process, i.e., causing a polymerization reaction at the interface of a core material comprising a hydrophobic monomer and a hydrophilic monomer, and the in situ polymerization microencapsulation process, i.e., forming a wall from outside (hydrophilic phase) or inside (hydrophobic phase) of a core material, such as urea-formaldehyde resin-walled capsules and melamine-formaldehyde resin-walled capsules, the above-described "stain" is liable to appear.

SUMMARY OF THE INVENTION

An object of the present invention is to provide a pressure-sensitive recording material which does not form stains upon encapsulation by the in situ polymerization process or interfacial polymerization process using a benzhydrylsulfone type color former.

The above-described object of the present invention has been successfully attained by a pressure-sensitive recording material comprising a base paper having coated thereon microcapsules containing a solution including a benzhydrylsulfone type color former and an amine-hydrophobic alkylene oxide adduct.

DETAILED DESCRIPTION OF THE INVENTION

As the benzhydrylsulfone type color former to be used in the present invention, those compounds which are represented by formula (I) below are preferable.

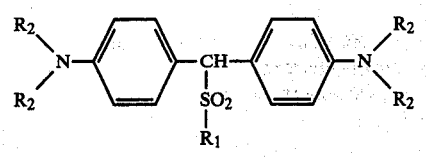

(I)

In formula (I), $R_1$ represents a monovalent group containing from 5 to 25 carbon atoms, and $R_2$ represents a lower alkyl group containing from 1 to 5 carbon atoms.

In formula (I), the monovalent group represented by $R_1$ is preferably an alkyl group containing from 6 to 20 carbon atoms, a cycloalkyl group containing from 5 to 16 carbon atoms, an aralkyl group containing from 7 to 20 carbon atoms, an alkyl-substituted aryl group containing a total of from 11 to 25 carbon atoms, an acylamino-substituted aryl group containing a total of from 12 to 25 carbon atoms, an alkoxy-substituted aryl group containing a total of from 10 to 25 carbon atoms, an acyloxy-substituted aryl group containing a total of from 10 to 25 carbon atoms, an aryloxy-substituted aryl group containing a total of from 12 to 25 carbon atoms, or an aralkyl-substituted aryl group containing a total of from 13 to 25 carbon atoms, with an alkyl-substituted aryl group containing a total of from 14 to 25 carbon atoms or an alkoxy-substituted aryl group containing a total of from 12 to 25 carbon atoms being particularly preferable. As the lower alkyl group represented by $R_2$, an alkyl group containing from 1 to 5 carbon atoms is useful. A methyl group, ethyl group, propyl group, or butyl group are preferable, with a methyl group being particularly preferable.

Specific examples of the compound represented by formula (I) are illustrated below.

(1) (4,4'-Bis-dimethylamino)diphenylmethyl-n-octylsulfone;
(2) (4,4'-Bis-dimethylamino)diphenylmethyl-n-dodecylsulfone;
(3) (4,4'-Bis-dimethylamino)diphenylmethyl-n-hexadecylsulfone;
(4) (4,4'-Bis-dimethylamino)diphenylmethyl-n-octadecyl sulfone;
(5) (4,4'-Bis-dimethylamino)diphenylmethyl-cyclohexylsulfone;
(6) (4,4'-Bis-dimethylamino)diphenylmethyl-methylcyclohexylsulfone;
(7) (4,4'-Bis-dimethylamino)diphenylmethyl-dimethylcyclohexylsulfone;
(8) (4,4'-Bis-dimethylamino)diphenylmethyl-benzylsulfone;
(9) (4,4'-Bis-dimethylamino)diphenylmethyl-2-phenethylsulfone;
(10) (4,4'-Bis-dimethylamino)diphenylmethyl-3-phenylpropylsulfone;
(11) (4,4'-Bis-dimethylamino)diphenylmethyl-α-methylbenzylsulfone;
(12) (4,4'-Bis-dimethylamino)diphenylmethyl-p-octylbenzylsulfone;
(13) (4,4'-Bis-dimethylamino)diphenylmethyl-p-dodecylbenzylsulfone;
(14) (4,4'-Bis-dimethylamino)diphenylmethyl-n-amylphenylsulfone;
(15) (4,4'-Bis-dimethylamino)diphenylmethyl-tert-amylphenylsulfone;
(16) (4,4'-Bis-dimethylamino)diphenylmethyl-diisopropylphenylsulfone;
(17) (4,4'-Bis-dimethylamino)diphenylmethyl-triisopropylphenylsulfone;
(18) (4,4'-Bis-dimethylamino)diphenylmethyl-di-tert-butylphenylsulfone;
(19) (4,4'-Bis-dimethylamino)diphenylmethyl-octylphenylsulfone;
(20) (4,4'-Bis-dimethylamino)diphenylmethyl-nonylphenylsulfone;
(21) (4,4'-Bis-dimethylamino)diphenylmethyl-dodecylphenylsulfone;
(22) (4,4'-Bis-dimethylamino)diphenylmethyl-tetrahydronaphthylsulfone;
(23) (4,4'-Bis-dimethylamino)diphenylmethyl-isopropylnaphthylsulfone;
(24) (4,4'-Bis-dimethylamino)diphenylmethyl-diisopropylnaphthylsulfone;
(25) (4,4'-Bis-dimethylamino)diphenylmethyl-cyclohexylphenylsulfone;
(26) (4,4'-Bis-dimethylamino)diphenylmethyl-α-methylbenzylphenylsulfone;
(27) (4,4'-Bis-dimethylamino)diphenylmethyl-diphenylmethylphenylsulfone;
(28) (4,4'-Bis-dimethylamino)diphenylmethyl-benzylphenylsulfone;
(29) (4,4'-Bis-dimethylamino)diphenylmethyl-phenoxyphenylsulfone;
(30) (4,4'-Bis-dimethylamino)diphenylmethyl-octyloxyphenylsulfone;
(31) (4,4'-Bis-dimethylamino)diphenylmethyl-dodecyloxyphenylsulfone;
(32) (4,4'-Bis-dimethylamino)diphenylmethyl-octanoylaminophenylsulfone;
(33) (4,4'-Bis-dimethylamino)diphenylmethyl-dodecanoylaminophenylsulfone;
(34) (4,4'-Bis-dimethylamino)diphenylmethyl-dodecanoyloxyphenylsulfone;
(35) (4,4'-Bis-diethylamino)diphenylmethyl-n-dodecylsulfone;
(36) (4,4'-Bis-dibutylamino)diphenylmethyl-n-dodecylsulfone;
(37) (4,4'-Bis-diethylamino)diphenylmethyl-benzylsulfone; and the like.

These benzhydrylsulfone compounds can be used in combination with other color formers. In particular, when crystal violet lactone is used as the other color former in combination with these benzhydrylsulfone compounds of 10 to 200% by weight, preferably 50 to 100% by weight, based on the weight of crystal violet lactone, they provide colored products having improved durability and prevent base paper coloration, and thus such a combination is most preferable.

However, other color formers such as triarylmethane compounds, xanthene compounds, spiro compounds, and thiazole compounds can be used as well.

As the amine-hydrophobic alkylene oxide adduct to be used in the present invention together with the benzhydrylsulfone color former, those compounds are preferable which are prepared by adding propylene oxide, butylene oxide, styrene oxide, or the like to an amine. Preferable examples of the amine include compounds represented by formula (II):

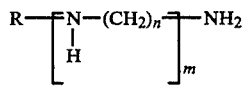

(II)

wherein R represents a hydrogen atom or an alkyl group, m represents 0 or an integer of 1 to 8, and n represents an integer of 1 to 12.

The hydrophobic alkylene oxide is added to these amines in an amount of from 5 to 100 mols, and preferably from 10 to 50 mols, per mol of the amines.

As the hydrophobic alkylene oxide, propylene oxide and butylene oxide are particularly preferable. Furthermore, the hydrophobic alkylene oxides may be added to the amines solely or in combinations of two or more thereof. Specific examples of the adducts are illustrated below.

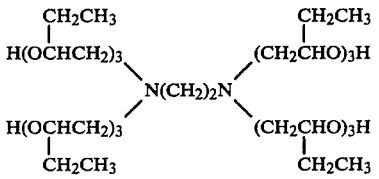

(1)

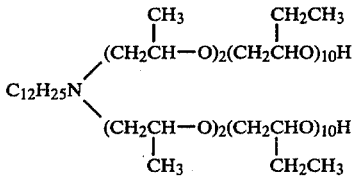

(2)

-continued (3)

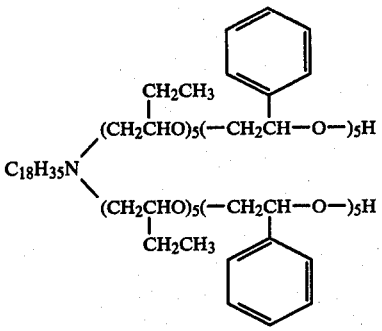

(4)

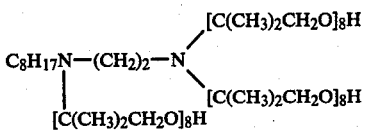

(5)

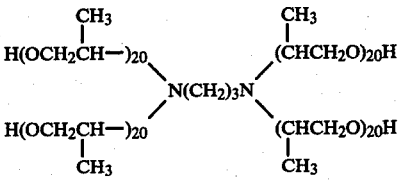

(6)

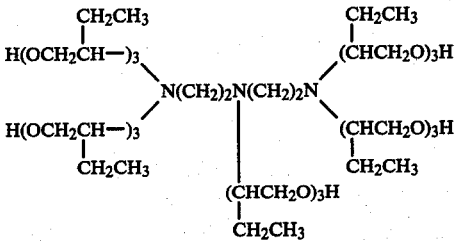

(7)

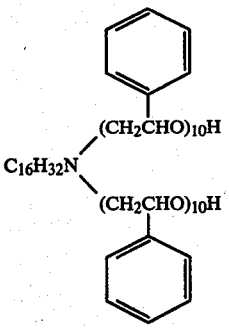

These hydrophobic alkylene oxide adducts are used in an amount of from 1 to 50 wt%, and preferably from 5 to 30 wt% of the amount benzhydrylsulfone type color former used.

Of the amine-alkylene oxide adducts, those with a high water solubility show only low effects. As the hydrophobic alkylene oxide to be added, butylene oxide is most preferable, with longer oxides being less effective.

In the present invention, the benzhydrylsulfone type color former and the amine-hydrophobic alkylene oxide adduct are dissolved in a solvent and microencapsulated. Examples of the solvents to be used include paraffin oil having a boiling point of 120° C. or more, chlorinated paraffin (chlorination degree: about 15% to 60%), and alkyl- or aralkyl-benzene or naphthalene (alkyl moiety containing about 5 or less carbon atoms) such as triphenylmethane, diphenyltolylmethane, xylylphenylethane, benzylxylene, α-methylbenzyltoluene, diisopropylnaphthalene, isobutylbiphenyl, tetrahydronaphthalene, hydrogenated terphenyl, di-α-methylbenzylxylene, tert-butyl-diphenyl ether, styrene dimer, etc.

Microcapsules to be used in the present invention can be prepared, for example, by a process utilizing coacervation as described in U.S. Pat. Nos. 2,800,457 and 2,800,458, a process of interfacial polymerization as described in British Pat. No. 990,443 and U.S. Pat. No. 3,287,154, a process of polymer precipitation as described in U.S. Pat. Nos. 3,418,250 and 3,660,304 and Japanese Patent Publication No. 23165/72, and a process of reactant polymerization from inside the oil droplets as described in U.S. Pat. Nos. 3,726,804 and 3,796,669. In particular, a process of forming capsule wall outside oil droplets is advantageous in the point of forming highly concentrated fine oil droplets.

The color former is used in an amount of from about 0.03 to 0.5 g/m$^2$, and the color developer is used in an amount of from about 0.1 to about 2 g/m$^2$.

In the present invention, particularly remarkable effects can be obtained by using acid clay and clay minerals such as bentonite and kaolin as the color developer. However, other color developers can be used. Examples of other color developers include phenol resins, aromatic carboxylic acid polyvalent metal salts, etc.

The present invention will now be described in more detail by reference to examples of preferred embodiments of the present invention, which, however, are not to be construed as limiting the present invention.

EXAMPLES 5 g of partial sodium salt of polyvinylbenzenesulfonic acid (made by National Starch Co.; VERSA TL500 (trademark); mean molecular weight: 500,000) was added to 95 g of 80° C. hot water with stirring to dissolve it, then cooled. The pH of the resulting aqueous solution was from 2 to 3. A 20 wt% sodium hydroxide aqueous solution was added thereto to adjust the pH to 4.0.

2 g of (4,4'-bis-dimethylamino)diphenylmethyl-n-dodecylsulfone and 1.7 g of crystal violet lactone were dissolved in 100 g of alkylnaphthalene under heating. In this solution were dissolved 0.3 g of methylenebisphenylisocyanate (Millionate MR (trademark); made by Nippon Polyurethane Industry KK) and 0.3 g of an amine-hydrophobic alkylene oxide adduct shown in Table 1 to prepare a color former solution. This solution was added to the above-prepared polyvinylbenzenesulfonate aqueous solution under vigorous stirring to emulsify and form an oil-in-water emulsion. When the oil droplet size became about 4.5μ, the stirring was discontinued to obtain an emulsion.

Separately, 6 g of melamine, 11 g of a 37 wt% of formaldehyde aqueous solution, and 83 g of water were heated to 60° C. under stirring, and, after 30 minutes, a transparent melamine-formaldehyde incipient condensate solution was obtained. This aqueous solution had a pH of 6 to 8. The incipient condensate solution obtained as described above was added to the above-described emulsion and mixed. The pH of the solution was adjusted to 6.0 by adding a 20 wt% acetic acid solution under stirring. Then, the solution temperature was raised to 65° C., and the stirring was continued for 30 minutes to form microcapsules.

To the thus obtained microcapsule solution were added 20 g of starch particles having an average particle size of 12μ and 100 g of a 15% polyvinyl alcohol aqueous solution, followed by adjusting the pH of the solution to 10.0 by using a sodium hydroxide aqueous solution.

This was coated on 40 g/m² woodfree paper (high-grade paper) in a solid (dry) amount of 5.0 g/m² by using a coating rod.

Testing method

Coloration (stain) of the coated surface of the thus obtained coated paper was measured as a reflection density for 620 mμ light.

Further, coloration degree was similarly measured after 24 hours under an atmosphere of 90% RH and 50° C.

The results thus obtained are shown in Table 1.

TABLE 1

| | Amine-Hydrophobic Alkylene Oxide Adduct | Color Density On Coated Surface | Color Density After Treating for 24 Hrs at 90% RH and 50° C. |
|---|---|---|---|
| Example 1 | Illustrative Compound No. (1) | 0.062 | 0.064 |
| Example 2 | Illustrative Compound No. (3) | 0.063 | 0.066 |
| Example 3 | Illustrative Compound No. (6) | 0.059 | 0.063 |
| Comparative Example 1 | Not Added | 0.125 | 0.220 |

Table 1 clearly shows the effects of the present invention. That is, when the benzhydrylsulfone color former was used without using the amine-hydrophobic alkylene oxide adduct, the color density of the coated surface was so serious that the commercial value was seriously affected. This tendency increased under the conditions of high temperature and high humidity.

In contrast, when the amine-hydrophobic alkylene oxide adduct of the present invention was used in combination, coloration of the coated surface was completely prevented, and no problems arose even when the samples were stored under conditions of high temperature and high humidity.

Also, when the coated sheet was combined with a color developer-coated paper to form color, extremely high color density was obtained.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording material comprising a base paper having coated thereon microcapsules containing a solution including a benzhydrylsulfone type color former and an amine-hydrophobic alkylene oxide adduct.

2. A pressure-sensitive recording material as in claim 1, wherein the microcapsules are formed by an in situ polymerization process or an interfacial polymerization process.

3. A pressure-sensitive recording material as in claim 1 or 2, wherein the benzhydrylsulfone type color former is represented by formula (I)

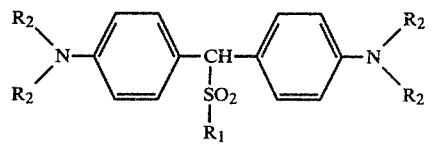

(I)

wherein $R_1$ represents a monovalent group containing from 5 to 25 carbon atoms and $R_2$ represents a lower alkyl group.

4. A pressure-sensitive recording material as in claim 3, wherein the monovalent group represented by $R_1$ is an alkyl group containing from 6 to 20 carbon atoms, a cycloalkyl group containing from 5 to 16 carbon atoms, and aralkyl group containing from 7 to 20 carbon atoms, an alkyl-substituted aryl group containing a total of from 11 to 25 carbon atoms, an acylamino-substituted aryl group containing a total of from 12 to 25 carbon atoms, an alkoxy-substituted aryl group containing a total of from 10 to 25 carbon atoms, an acyloxy-substituted aryl group containing a total of from 10 to 25 carbon atoms, an aryloxy-substituted aryl group containing a total of from 12 to 25 carbon atoms, or an aralkyl-substituted aryl group containing a total of from 13 to 25 carbon atoms.

5. A pressure-sensitive recording material as in claim 4, wherein $R_1$ is an alkyl-substituted aryl group containing a total of from 14 to 25 carbon atoms or an alkoxy-substituted aryl group containing a total of from 12 to 25 carbon atoms.

6. A pressure-sensitive recording material as in claim 1 or 2, wherein the microcapsules additionally contain crystal violet lactone.

7. A pressure-sensitive recording material as in claim 1 or 2, wherein the amine-hydrophobic alkylene oxide adduct is prepared by adding hydrophobic alkylene oxide such as propylene oxide, butylene oxide, or styrene oxide to an amine.

8. A pressure-sensitive recording material as in claim 7, wherein the amine is represented by formula (II)

$$R\text{-}NH\text{-}(CH_2)_n\text{-}_m NH_2 \quad \text{(II)}$$

wherein R represents a hydrogen atom or an alkyl group, m represents 0 or an integer of 1 to 8, and n represents an integer of 1 to 12.

9. A pressure-sensitive recording material as in claim 7, wherein the hydrophobic alkylene oxide is added to the amine in an amount of from 5 to 100 mols per mol of amine.

10. A pressure-sensitive recording material as in claim 7, wherein the hydrophobic alkylene oxide is added to the amine in an amount of from 10 to 50 mols per mol of amine.

11. A pressure-sensitive recording material as in claim 1 or 2, wherein the amine-hydrophobic alkylene oxide adduct is used in an amount of from 1 to 50 wt% of the amount of benzhydrylsulfone type color former used.

12. A pressure-sensitive recording material as in claim 1 or 2, wherein the amine-hydrophobic alkylene oxide adduct is used in an amount of from 5 to 30 wt% of the amount of the benzhydrylsulfone type color former used.

13. A pressure-sensitive recording material as in claim 1 or 2, wherein the color former is used in an amount of from about 0.03 to 0.5 g/m².

14. A pressure-sensitive recording material as in claim 13, wherein the color developer selected from acid clay and clay material is incorporated in said pressure-sensitive recording material in an amount of from 0.1 to 2 g/m².

* * * * *